US007401785B1

(12) United States Patent
Waite

(10) Patent No.: US 7,401,785 B1
(45) Date of Patent: Jul. 22, 2008

(54) LAWN GAME WITH UPRIGHT TARGET AND METHOD OF PLAY

(75) Inventor: Lance M Waite, Encinitas, CA (US)

(73) Assignee: Röckport Recreation, LLC, Encinitas, CA (US)

( * ) Notice: Subject to any disclaimer, the term of this patent is extended or adjusted under 35 U.S.C. 154(b) by 0 days.

(21) Appl. No.: 11/800,237

(22) Filed: May 4, 2007

(51) Int. Cl.
*A63B 63/00* (2006.01)

(52) U.S. Cl. ..... 273/400; 473/476

(58) Field of Classification Search ..... 273/398–402, 273/348; 473/195–197, 170, 476–479
See application file for complete search history.

(56) References Cited

U.S. PATENT DOCUMENTS

| | | | | | |
|---|---|---|---|---|---|
| 453,310 | A | | 6/1891 | Reed | |
| 469,554 | A | | 2/1892 | Favor | |
| 607,020 | A | | 7/1898 | Dodge | |
| 823,507 | A | | 6/1906 | Carr | |
| 1,208,235 | A | * | 12/1916 | Thayer | 273/400 |
| 1,392,662 | A | * | 10/1921 | Seibold | 273/400 |
| 1,527,988 | A | | 3/1925 | Stewart | |
| 1,783,338 | A | | 12/1930 | Mann | |
| 1,923,152 | A | * | 8/1933 | Kohn | 473/190 |
| 1,996,986 | A | | 4/1935 | Weinberg | |
| 2,540,288 | A | | 2/1951 | Powers | |
| 3,231,280 | A | * | 1/1966 | Coliins | 473/195 |
| 3,490,769 | A | * | 1/1970 | Torbett | 473/196 |
| 3,495,830 | A | | 2/1970 | Farrelli | |
| 3,526,405 | A | * | 9/1970 | Morris | 473/191 |
| 3,540,734 | A | * | 11/1970 | Temple | 473/196 |
| 3,719,362 | A | * | 3/1973 | Blanchard | 473/194 |
| 4,012,042 | A | | 3/1977 | Blasingame | |
| D276,448 | S | | 11/1984 | Kim et al. | |
| 4,750,744 | A | * | 6/1988 | Michalec | 473/195 |
| 4,796,886 | A | * | 1/1989 | Loh | 473/462 |
| 5,096,191 | A | * | 3/1992 | Fang | 473/485 |
| 5,123,656 | A | | 6/1992 | Green | |
| 5,269,527 | A | * | 12/1993 | Noval | 473/197 |
| 5,320,360 | A | | 6/1994 | St. Pierre | |
| 5,330,199 | A | * | 7/1994 | Vand | 273/400 |
| 5,332,230 | A | | 7/1994 | Benedict | |
| 5,439,224 | A | * | 8/1995 | Bertoncino | 473/153 |
| D408,462 | S | | 4/1999 | Frycz | |
| D429,303 | S | * | 8/2000 | Peterson, Jr. | D21/790 |
| 6,250,635 | B1 | * | 6/2001 | Chittenden | 273/400 |
| 6,659,466 | B2 | * | 12/2003 | Searles et al. | 273/400 |
| 6,948,713 | B1 | * | 9/2005 | Grunfeld | 273/400 |
| 7,066,824 | B2 | * | 6/2006 | Wenzler | 473/197 |

(Continued)

FOREIGN PATENT DOCUMENTS

| | | | |
|---|---|---|---|
| FR | 2651141 | A1 * | 3/1991 |

*Primary Examiner*—Mark S Graham
(74) *Attorney, Agent, or Firm*—Gene Scott, Patent Law & Venture Group

(57) ABSTRACT

A game target is supported by a plurality of legs capable of remaining sure on both grass and concrete. The target is partitioned by the target frame into a plurality of zones. A pocket, attached to the target frame, occupies each zone. The pockets are of an appropriate depth to hold a plurality throwing projectiles. The target is supported in a reclining orientation in order to align with the typical trajectory of an underhand throw thereby better facilitating the capture of a throwing ball in a pocket.

6 Claims, 4 Drawing Sheets

U.S. PATENT DOCUMENTS

2002/0111234 A1* 8/2002 MacNichol ..... 473/446
2002/0183128 A1* 12/2002 Cho ..... 473/197
2003/0008721 A1* 1/2003 Macaluso ..... 473/197
2003/0025272 A1* 2/2003 Billig et al. ..... 273/400
2005/0192126 A1* 9/2005 Remaklus ..... 473/447
2007/0052178 A1* 3/2007 Cottrell ..... 273/402
2007/0187897 A1* 8/2007 Dilling ..... 273/407

* cited by examiner

LAWN GAME WITH UPRIGHT TARGET AND METHOD OF PLAY

CROSS-REFERENCE TO RELATED APPLICATIONS

Not Applicable

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to portable lawn games and more particularly to a game of coordination whereby players compete in their ability to accurately toss small projectiles into an upright target divided into zones having point values.

2. Description of Related Art Including Information Disclosed Under 37 CFR 1.97 and 1.98

Kim et. al., U.S. D 276448, discloses an ornamental design for a tossing game.

Frycz, U.S. D 408462, discloses an ornamental design for a beanbag tossing game target.

Benedict, U.S. Pat. No. 5,332,230, discloses a foldable target structure including a first, second, and third game plate, each having distinctive geometrical configurations arranged for opening and securement in a triangular configuration, wherein a central opening includes a central opening periphery fastener structure about the central opening through each game plate, with further openings and further hook and loop fastener peripheries, as well as hook and loop fastener patches mounted upon each game plate of various geometrical configurations between respective game plates. The bag structure employed includes bag first and second sides, having first and second side hook and loop fastener surfaces arranged for securement to the hook and loop fastener surfaces of the game plates, wherein various point totals are awarded for directing the bag member through the opening, as well as the bag's adherence to hook and loop fastener surfaces of respective game plate structure.

St. Pierre, U.S. Pat. No. 5,320,360, discloses a target game apparatus including an inclined main target base having a top panel and plurality of holes with a receptacle area behind the panel to receive objects when successfully falling through the holes. A vertical rear panel stands up from the rear edge of the main target base and includes one or more holes through which the objects can pass when successfully thrown. The construction can fold into a collapsed condition by pushing the receptacle base into the area behind the top panel of the main target base and by folding the rear panel rearwardly and downwardly so as to lie underneath the base panel of the receptacle. The legs fold into the area between the top panel and the sides of the receptacle.

Green, U.S. Pat. No. 5,123,656, discloses an apparatus for playing a game of toss. The game may be played by people of all ages and physical abilities, and may be played from a sitting or standing position. The game is adaptable for indoor and outdoor play. The apparatus for a game of toss includes a plurality of tossing objects such as bean bags or balls for tossing toward a target receptacle. A target receptacle includes at least an inner and an outer vertical receptacle with side walls such that volumes are defined within the inner wall and between the inner wall and the outer wall, respectively. In the preferred embodiment, the outer wall includes a forward portion with a depending section proximate the top such that a larger opening for the passage of the tossing object is provided. The inner and outer walls are attached to a base such that the walls do not move in relation to one another during play. The target receptacle of the preferred embodiment may be easily disassembled for transport and storage. Scoring is determined by the number of tossing objects landing within the separate volumes, with a greater number of points awarded for a tossing object landing within the central volume.

Blasingame, U.S. Pat. No. 4,012,042, discloses a game utilizing at least one target tray structure having a pocket therein at which disc shaped projectiles are thrown. The tray is invertible to provide either a single pocket of a predetermined scoring value or to provide an array of pockets having various scoring values.

Farrelli, U.S. Pat. No. 3,495,830, discloses a substitution for the game of darts that includes a plurality of outwardly facing cups on a substantially vertical base board in combination with a ball which the player attempts to toss in one of the cups. To facilitate the seating of the ball in a cup, the cup is flexibly mounted and a vent means is provided to avoid entrapment of air behind the ball.

Powers, U.S. Pat. No. 2,540,288, discloses a target including a thin circular board having a co-planar projecting peripheral flange, a base support secured to the rear side of the flange and disposed at right angles to the board to support the board disposed in a vertical position on the edge of the flange, a peg projecting rearwardly from an edge of the board, the edge receiving the peg being diametrically opposed to the base flange with the peg paralleling and overlying the base support and being coextensive therewith, said peg functioning as a counter weight when the board is in a vertical position and cooperative with the base support to support the board in a horizontal position, said board being formed with transverse openings arranged in a predetermined pattern and provide with different scoring values.

Weinberg, U.S. Pat. No. 1,996,986, discloses a game for use with a missile including a board having ectagular central field, and means for supporting such field at an incline and said board having at opposite sides outwardly flaring wings, said wings having missile—receiving pockets.

Mann, U.S. Pat. No. 1,783,338, discloses a game apparatus for use with a missile including a board with missile receiving pockets, the board having a rectangular central field, and means for supporting such field at an incline and also having at opposite sides outwardly flaring wings. The wings having missile-receiving pockets.

Carr, U.S. Pat. No. 823,507, discloses a game-board comprising a base provided with a series of pockets upon the upper surface thereof, molding surrounding the edge of the base, and a covering of fabric, located upon the upper surface of the base about the pockets.

Dodge, U.S. Pat. No. 607,020, discloses a game apparatus including a board having an opening formed therein, a pocket arranged beneath said opening, supporting-legs hinged to the board and adapted to fold there-on. The apparatus also includes a means for securing the legs in position for supporting the board, and a board hinged at one edge to said board and adapted to fold thereon when not in use, said hinged board forming an inclined plane leading to the pocket, substantially as described.

Favor, U.S. Pat. No. 469,554, discloses a game apparatus including a yielding body having a series of graduated opening produced therein of predetermined dimensions, pockets at the back of the openings, a transverse pocket on the lower edge of the body, posts and devices for connecting the body to the posts, whereby the said body is maintained in an inclined position, as and for the purpose specified.

Reed, U.S. Pat. No. 453,310, discloses a game apparatus including a supporting base, a dial pivoted upon the upper end thereof and provided with a number of holes with figures adjacent, and a rubber ball adapted to pass through any of the holes.

McMurtrie, U.S. Pat. No. 1,527,988, discloses an apparatus for use in playing an outdoor game including a substantially rectangular net made wholly of twine whose entire area is constituted by pockets arranged in rows, four post and means for anchoring the net to the post at the corners only.

Stewart, UK539206, discloses a game apparatus including a set of pockets, a plurality of playing positions spaced from the set of pockets and an indicator including a plurality of indicating panels each clearly visible from a corresponding playing position and a plurality of lamps corresponding with the pockets and adapted to reproduce a replica or indication of the pockets on each panel corresponding with the pockets as viewed by the player or players at the corresponding playing position.

The related art described above discloses games involving projectiles and targets whereby the target contains a plurality of scoring zones capable of accepting a projectile distributed among non-scoring zones that are incapable of accepting the projectile. The related art also discloses a rectangular target containing a continuous yet partitioned scoring zone whereby the entire target can accept the projectile. In this disclosure, each square partition can be assigned a different value thereby altering the incentives among the partitions. The prior art fails to disclose, however, a upright target with circular concentric scoring zones in a target plane where projectiles deposited in pockets closer to the center are assigned higher point values thereby penalizing inaccuracy equally in all directions on the target plane. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

An upright target is supported by a plurality of legs capable of being securely placed on either grass or concrete. The target is partitioned by a target frame into a plurality of concentric zones occupied by separate pockets. The pockets are of an appropriate depth to hold a plurality of projectiles. The target is supported in a slightly reclining orientation to align with the typical trajectory of an underhand throw thereby better facilitating the capture of the projectile.

A primary objective inherent in the above described apparatus and method of use is to provide advantages not taught by the prior art.

Another objective is to provide a portable game that is easily assembled and disassembled.

A further objective is to provide a game target with pockets occupying concentric radial zones where the pockets are designed with an appropriate fabric billowing and with elasticity to both accept and secure a plurality of projectiles.

A further objective is to provide a game target that accepts misguided projectiles and categorizes them into zones of radial accuracy allowing the point scorer to be graded and scored accordingly.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
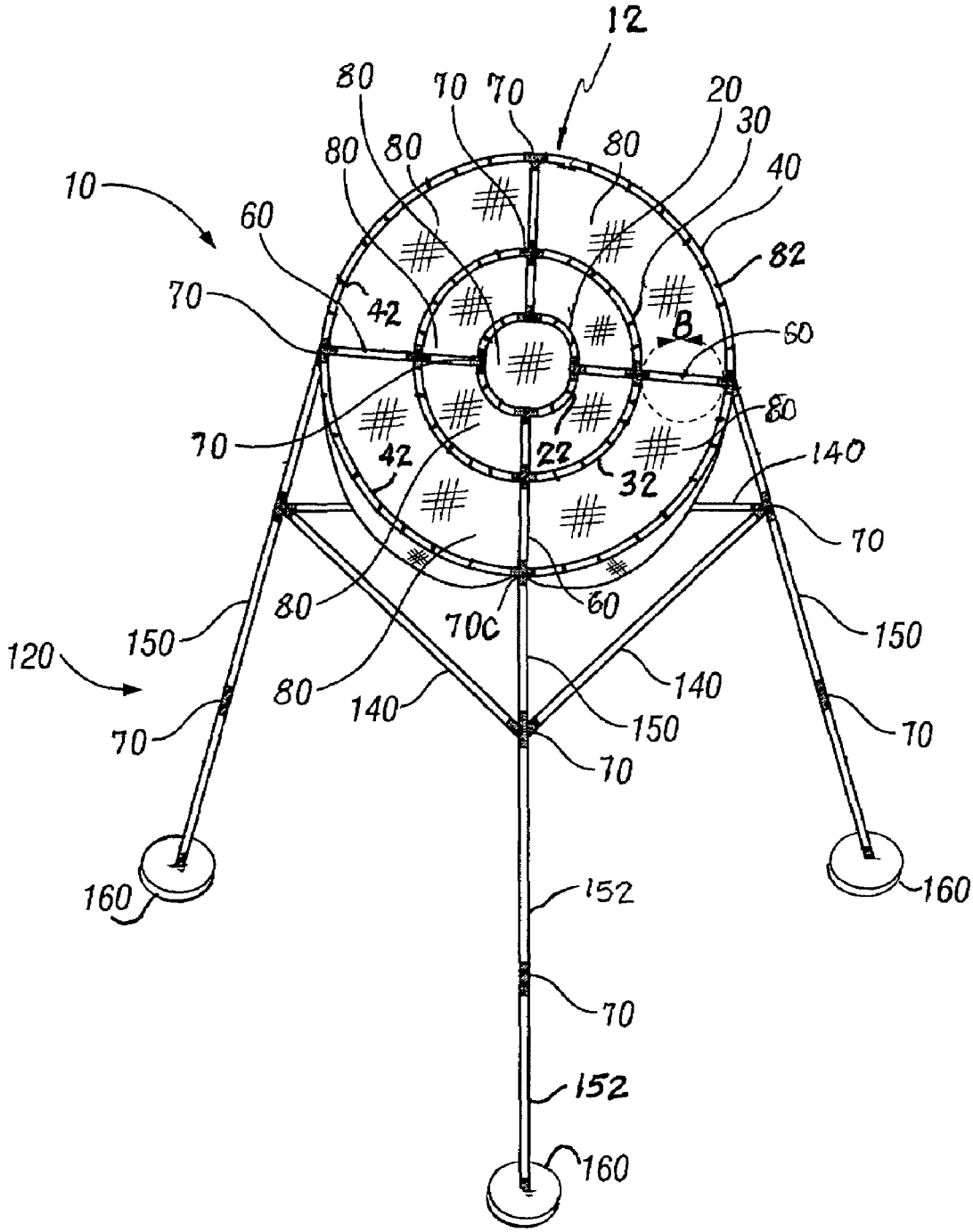
FIG. 1 is an elevated frontal view according to arrow "A" in FIG. 2, of the presently described apparatus.

Described now in detail is a game target 10 shown in FIG. 1. The target 10 has a plurality of structural rings (such as 20, 30, 40) in a concentric orientation creating partitioned scoring zones 50. The rings 20, 30, and 40 are supported by radial cross-members 60. The rings 20, 30, and 40 and cross-members 60 are each composed of individual segments that are impermanently joined their extremities by couplings 90 of various configurations. The rings 20, 30, 40 and cross members 60 are preferably manufactured from fiber glass rod but could also be made from aluminum, plastic or any other stiff, lightweight material.

Figure 4:
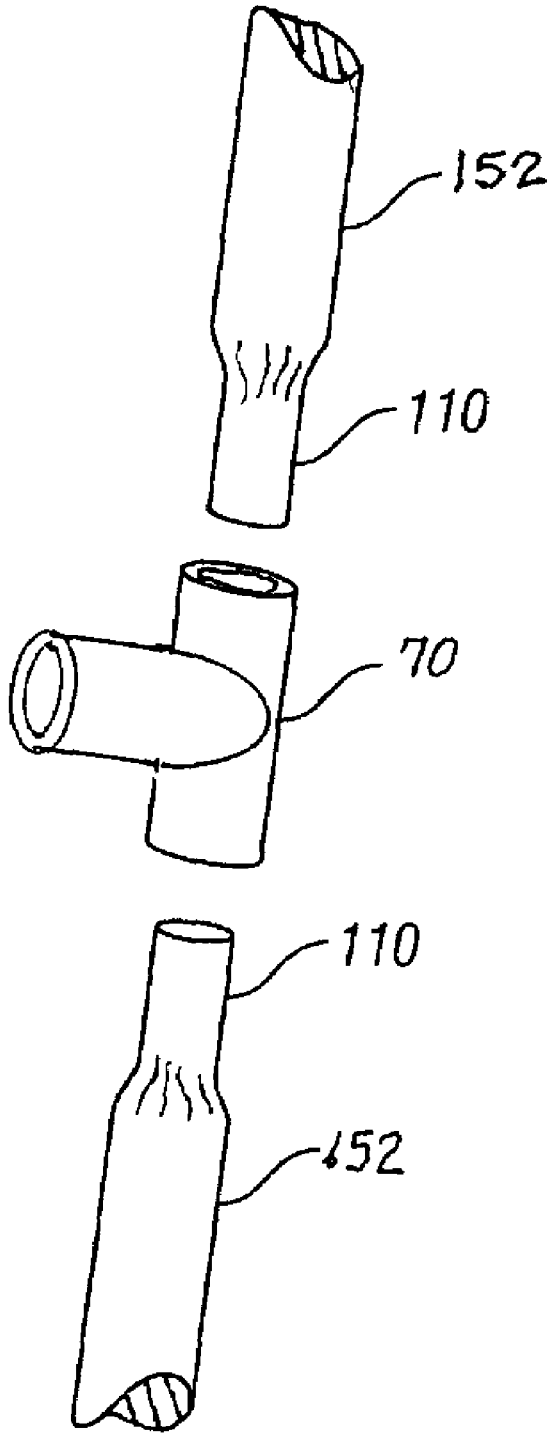
FIG. 4 is an exploded view of a portion of the described apparatus as shown in FIG. 1

The couplings 90 incorporate tubular sockets 100 sized to receive tapered ends 110 of each of the segments as seen in FIG. 4. The couplings 90 are preferably manufactured from a light-weight metal such as aluminum. The construction of the structural segments and couplings 90 construction allows the target 10 to be easily assembled and disassembled for convenient portability.

The target 10 is ideally supported by three legs 120 in a tripod orientation although alternate support configurations are possible. The legs 120 engage the target 10 at couplings 90 located on the outer most concentric ring 40. Stability braces

140 are positioned between legs 120 to add rigid support to the legs 120. In the preferred embodiment the legs 120 include three leg segments 150 attached by couplings 90. The two lower leg segments 150 are optional thereby allowing the target to be supported at three different leg lengths; approximately 30, 45, and 60 inches. Other embodiments of the present invention, such as telescoping legs, that allow the target to be supported at variable height are also possible. The legs 120 are preferably fitted with a rubber foot 160 for increased stability on a range of surfaces.

Figure 3:
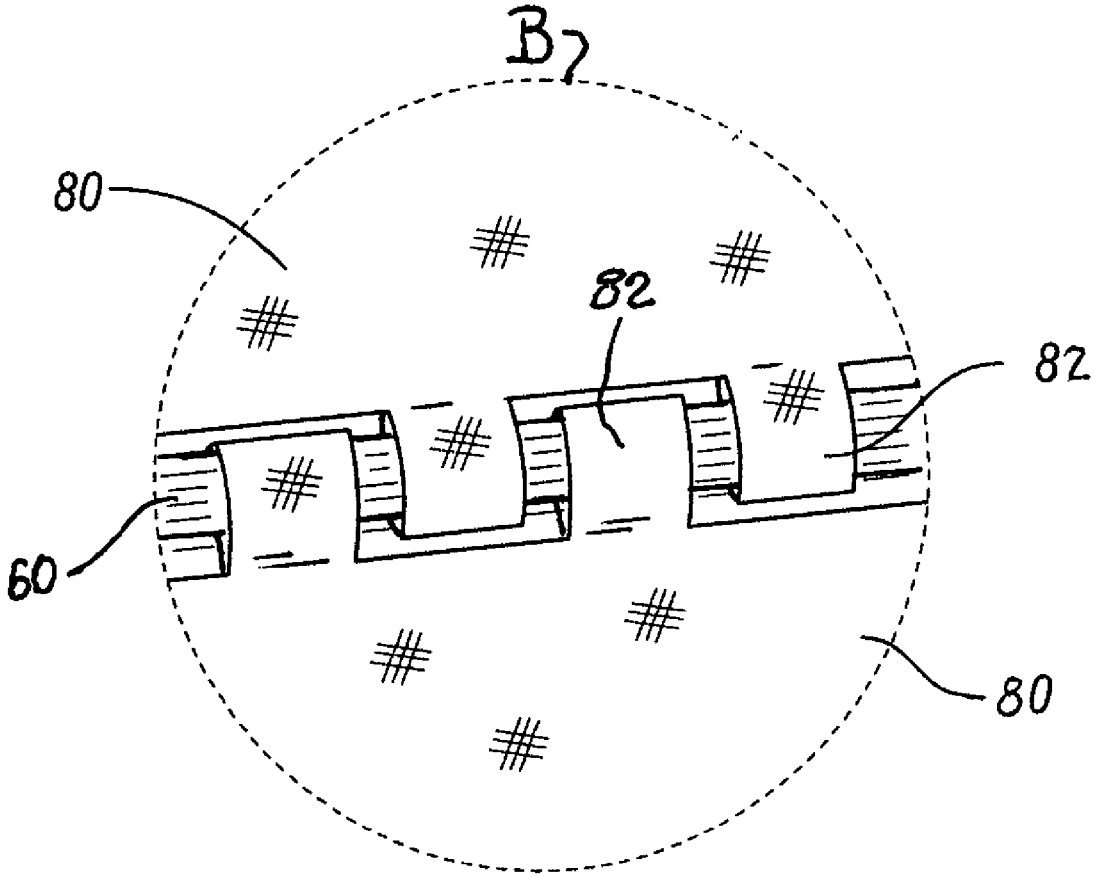
FIG. 3 is a magnified view of a portion of the described apparatus, as shown in FIG. 1.

Each scoring zone 50 is occupied by a pocket 170. The pocket 170 is fabricated from a light-weight fabric such as nylon. Scoring zones 50 may be assigned different point values and may be distinguished using distinctive color. The pockets 170 are attached to the target 10 by loops 180 stitched in the fabric that encircle the bordering segment 80 as shown in FIG. 3. The loops 180 are sufficiently spaced apart so as to allow loops 180 of the adjacent pocket 170 to access the bordering segment in an alternating fashion.

Figure 2:
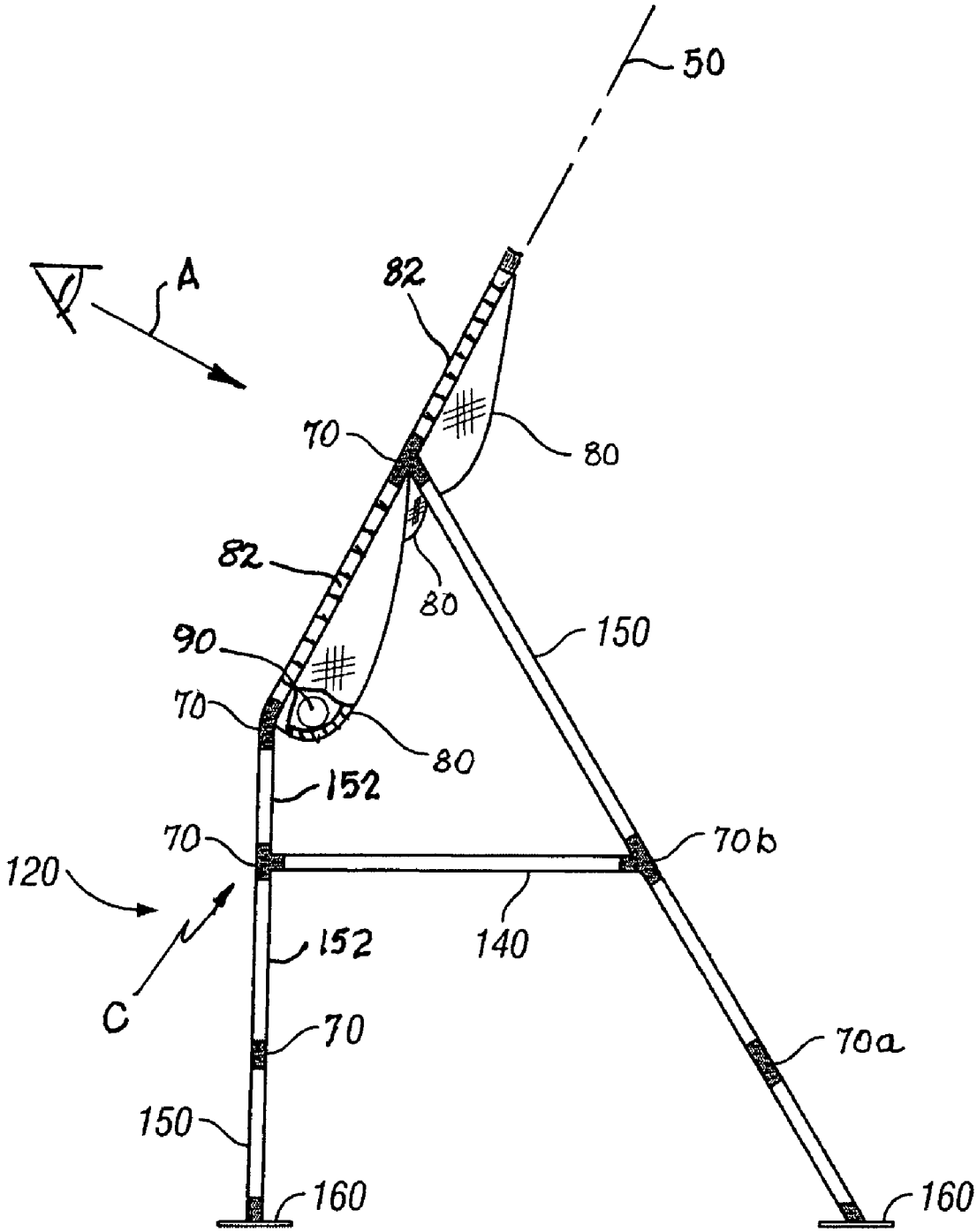
FIG. 2 is a side view thereof.

The pockets 170 are constructed from a sufficient amount of material so that the pocket billows when in the relaxed position. See FIG. 2. When the projectile is deposited into the pocket the pocket fabric distributes and dissipates the energy of the projectile thereby accepting it and preventing rebound. The pocket fabric is sized to maintain its damping characteristic while holding up to eight projectiles.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A standup target apparatus comprising: a plurality of concentric rings positioned in a target plane, each of the rings assembled from curved ring segments; a plurality of linear radial segments; a plurality of couplings, the couplings joining the ring segments with the radial segments to form a rigid frame; and a plurality of fabric pockets, each one of the pockets mounted to at least two of the ring segments by a series of spaced apart peripheral loops, the pockets each providing excessive surface area thereby establishing a billowed conformation rearwardly of the target plane.

2. The apparatus of claim 1 further comprising a stand providing at least three legs mutually joined by rigidizing braces.

3. The apparatus of claim 2 wherein the legs are of a length wherein the target plane is held at a tilted angle.

4. The apparatus of claim 2 wherein the legs terminate downwardly with feet configured for engaging a ground surface.

5. The apparatus of claim 1 wherein the curved ring segments and the linear radial segments are rods having reduced diameter opposing ends.

6. The apparatus of claim 5 wherein each said coupling is a tube having an inside diameter sized for accepting the reduced diameter opposing end of one of the segments.

* * * * *